US011779515B2

(12) United States Patent
Urfig

(10) Patent No.: US 11,779,515 B2
(45) Date of Patent: Oct. 10, 2023

(54) STEAM SHOWER SYSTEM AND DEVICE

(71) Applicant: Bernard E. Urfig, Costa Mesa, CA (US)

(72) Inventor: Bernard E. Urfig, Costa Mesa, CA (US)

( * ) Notice: Subject to any disclaimer, the term of this patent is extended or adjusted under 35 U.S.C. 154(b) by 0 days.

(21) Appl. No.: 17/462,656

(22) Filed: Aug. 31, 2021

(65) Prior Publication Data

US 2022/0062100 A1 Mar. 3, 2022

Related U.S. Application Data

(60) Provisional application No. 63/073,655, filed on Sep. 2, 2020.

(51) Int. Cl.

| | |
|---|---|
| ***A61H 33/06*** | (2006.01) |
| ***A61H 33/00*** | (2006.01) |
| ***B01F 23/40*** | (2022.01) |
| ***B01F 25/00*** | (2022.01) |

(52) U.S. Cl.

CPC ..... *A61H 33/065* (2013.01); *A61H 33/005* (2013.01); *A61H 33/067* (2013.01); *A61H 33/6036* (2013.01); *B01F 23/40* (2022.01); *B01F 25/1051* (2022.01); *A61H 2033/068* (2013.01)

(58) Field of Classification Search

CPC .. A61H 33/065; A61H 33/005; A61H 33/067; A61H 33/6036; A61H 2033/068; A61H 2033/0083; A61H 2201/0107; B01F 23/40; B01F 25/1051

USPC ..... 4/535, 537, 524

See application file for complete search history.

(56) References Cited

U.S. PATENT DOCUMENTS

| | | | | |
|---|---|---|---|---|
| 3,857,514 | A | 12/1974 | Clifton | |
| 3,945,881 | A | 3/1976 | Speidel | |
| 4,084,271 | A | 4/1978 | Ginsberg | |
| 4,424,598 | A | 1/1984 | Cima | |
| 4,432,103 | A | 2/1984 | Hunziker | |
| 4,685,221 | A | 8/1987 | Taylor et al. | |
| 5,142,713 | A | 9/1992 | Makool | |
| 5,211,813 | A | 5/1993 | Sawley et al. | |
| 5,293,653 | A | 3/1994 | Filipponi | |
| 5,551,637 | A | 9/1996 | Lo | |
| 5,713,309 | A | 2/1998 | Higashi | |
| 5,788,160 | A | 8/1998 | Woog | |
| 5,805,765 | A | 9/1998 | Altman | |
| 8,646,121 | B2 | 2/2014 | Nguyen | |
| 9,999,565 | B2 * | 6/2018 | Urfig | A61H 33/06 |
| 10,779,689 | B2 * | 9/2020 | Howard | A47K 3/30 |
| 2005/0241058 | A1 | 11/2005 | Li | |
| 2006/0208104 | A1 | 9/2006 | DeBoer et al. | |
| 2006/0248640 | A1 | 11/2006 | Leong | |

(Continued)

*Primary Examiner* — Lori L Baker

(74) *Attorney, Agent, or Firm* — Olav M. Underdal; IDP Patent Services

(57) ABSTRACT

A steam shower device includes a steam enclosure, including a front plate with first and second vacuum air vents, a rear wall, and a steam chamber; a steam mixing valve with a steam control dial; a mixed water line; a steam nozzle assembly with a stem nozzle head; a steam vent, including a perimeter wall and a perimeter ledge; a visual trim panel; a hot water pan; such that the steam vent is configured to emit steam from the steam chamber. Optionally, the steam shower device can include a hand-held steam hose, which is detachably connectable to the steam vent.

28 Claims, 16 Drawing Sheets

(56) References Cited

U.S. PATENT DOCUMENTS

| | | | | |
|---|---|---|---|---|
| 2007/0147808 | A1 | 6/2007 | Egeresi | |
| 2008/0184478 | A1 | 8/2008 | Howard | |
| 2016/0287471 | A1* | 10/2016 | Urfig | E03C 1/0408 |
| 2019/0246846 | A1* | 8/2019 | Howard | A61H 33/066 |
| 2020/0368104 | A1* | 11/2020 | Freier | A61H 33/066 |
| 2022/0062100 | A1* | 3/2022 | Urfig | A61H 33/6036 |

* cited by examiner

Steam Shower System

Steam Shower Device

Wireless/Bluetooth Electronic Module

STEAM SHOWER SYSTEM AND DEVICE

CROSS-REFERENCE TO RELATED APPLICATIONS

This application claims the benefit of U.S. Provisional Application No. 63/073,655, filed Sep. 2, 2020; which is hereby incorporated herein by reference in its entirety.

FIELD OF THE INVENTION

The present invention relates generally to the field of showers and shower devices, and more particularly to methods and systems for generating steam in a shower.

BACKGROUND OF THE INVENTION

Steam showers have become increasingly common in recent years.

However, such steam showers and wet saunas are often complex and expensive, and may require electrical power for operation. Designs that rely solely on hot and cold water supply frequently do not generate sufficient steam and may emit unwanted drops and spouts of hot water, and therefore have not been successful in the market place.

As such, considering the foregoing, it may be appreciated that there continues to be a need for novel and improved devices and methods for generating steam in a shower.

SUMMARY OF THE INVENTION

The foregoing needs are met, to a great extent, by the present invention, wherein in aspects of this invention, enhancements are provided to the existing model of steam showers.

In an aspect, a steam shower device can include:

a) a steam enclosure, including a front plate; a rear wall; and a steam chamber within walls of the steam enclosure;

b) a mixed water line, which is connected to a hot and cold water supply, such that mixed water is transmitted via the mixed water line;

c) a steam nozzle assembly, including at least one steam nozzle head; such that the steam nozzle head sprays the mixed water in a downward direction, such that the mixed water is partially atomized into a steam;

d) a steam vent, with a steam aperture, which is configured as an aperture in the front plate, such that the steam vent is configured to emit the steam from the steam chamber; and e) a hot water pan, which is a container with an upper opening, such that the hot water pan can collect excess condensed water from the steam, such that a hot water reservoir is contained by the hot water pan, whereby the hot water reservoir promotes steam formation.

In a related aspect, the steam shower device can further include a steam mixing valve, with a steam control dial.

In a related aspect, the steam shower device can further include first and second vacuum air vents, which are apertures in the steam enclosure, such that the second vacuum air vent is mounted below the first vacuum air vent; wherein the vacuum air vents are configured to enable an airflow from the vacuum air vents to the steam vent, which facilitates creation of a continuous and directed stream of the steam exiting the steam vent.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1:
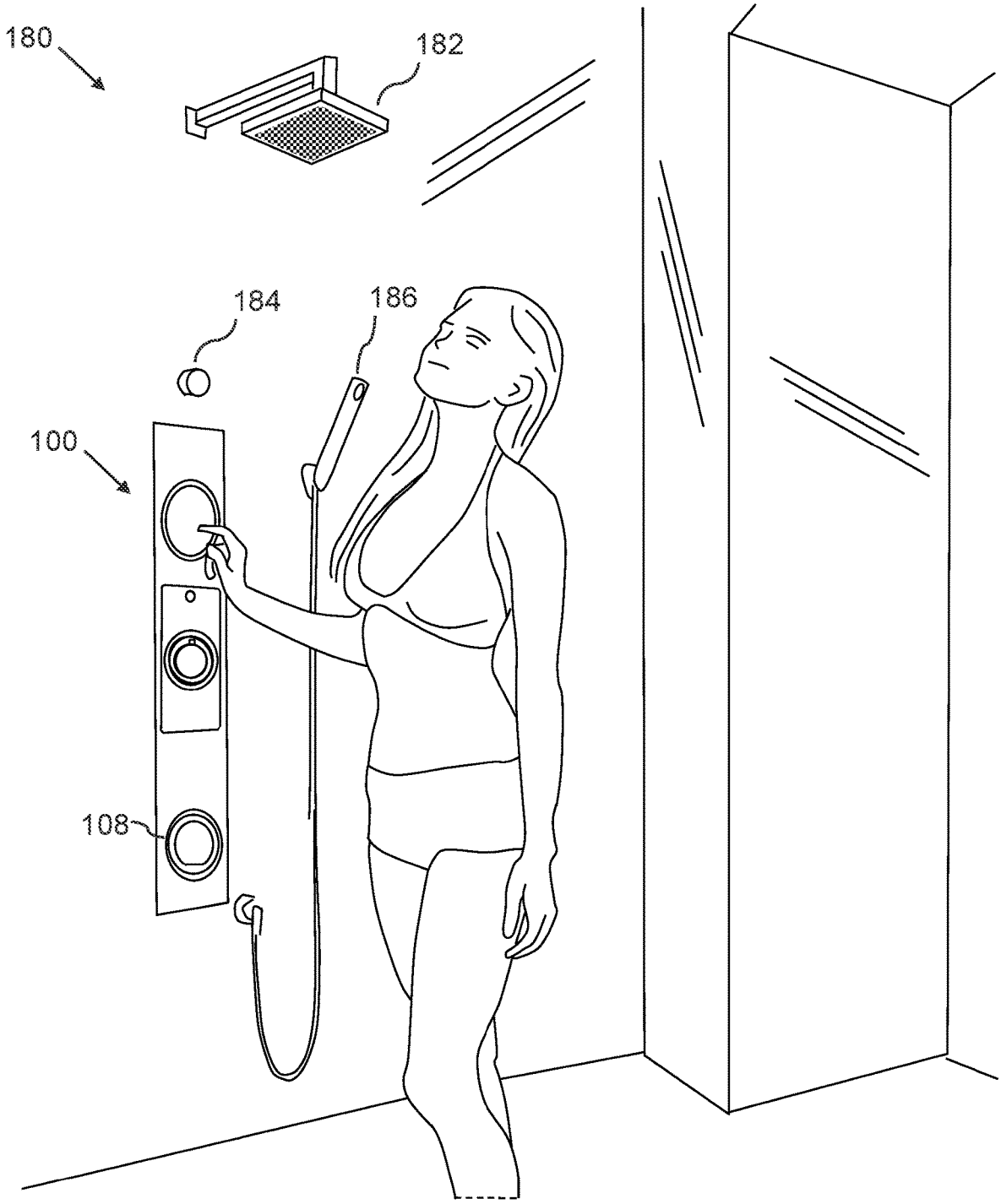
FIG. 1 is a perspective view of a steam shower system, according to an embodiment of the invention.

In an embodiment, a steam shower system 180, such as shown in FIG. 1, can be designed to provide a home owner, hotel or alike the ability to enjoy the benefits of a steam shower without having to use a generator or electricity, and also have the ability to install it far easier than other known steam shower systems.

In related embodiments, as shown in FIG. 1, a steam shower system 180 can function as a steam and complete shower system 180, which includes a steam shower device 100, which is designed to vent steam and heat into a shower enclosure, through a steam vent 108, thereby creating a steam shower, also known as a wet sauna. As well as providing a unique steam shower, the steam shower system 180 incorporates a complete shower system which can add other luxurious features such as a rainfall shower head, body sprays, and a BLUETOOTH™ audio system for a one of a kind shower experience.

In further related embodiments, the steam shower system 180:

a) Provides all functions of a state-of-the-art luxurious shower, combined into one beautifully designed system;

b) Allows easy installation by a qualified plumber or contractor with minimal installation complexity and cost; and c) Can be constructed entirely from high grade stainless steel, incorporating a modern, and beautiful design that will enhance a bathroom's appearance.

In an embodiment, as shown in FIG. 1, a steam shower system 180 can include:

a) a shower head 182, which as shown can be a rainfall shower head 182;

b) a secondary shower head 186, which as shown can be a back and shoulder shower head 186;

c) a shower control dial 184, further including a water mixer which mixes water from cold and hot water supply and transmits water to the shower head 182 and the secondary shower head 186;

d) a steam shower device 100, which can include:

i. a steam control dial 206; and ii. a steam vent 108, comprising a steam aperture 209, which is configured as an aperture in the front plate 202, such that the steam vent 108 is configured to emit steam that is generated in a steam chamber behind the front plate 202.

Figure 2:
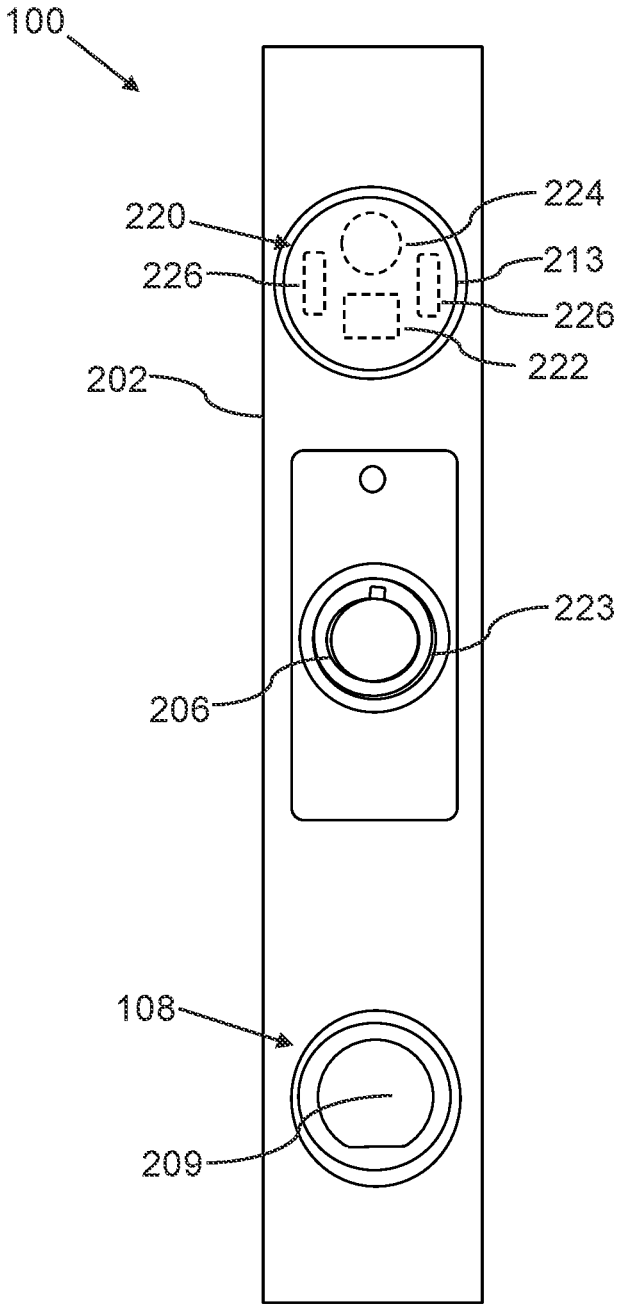
FIG. 2 is a perspective view of a steam shower device, according to an embodiment of the invention.
Figure 3:
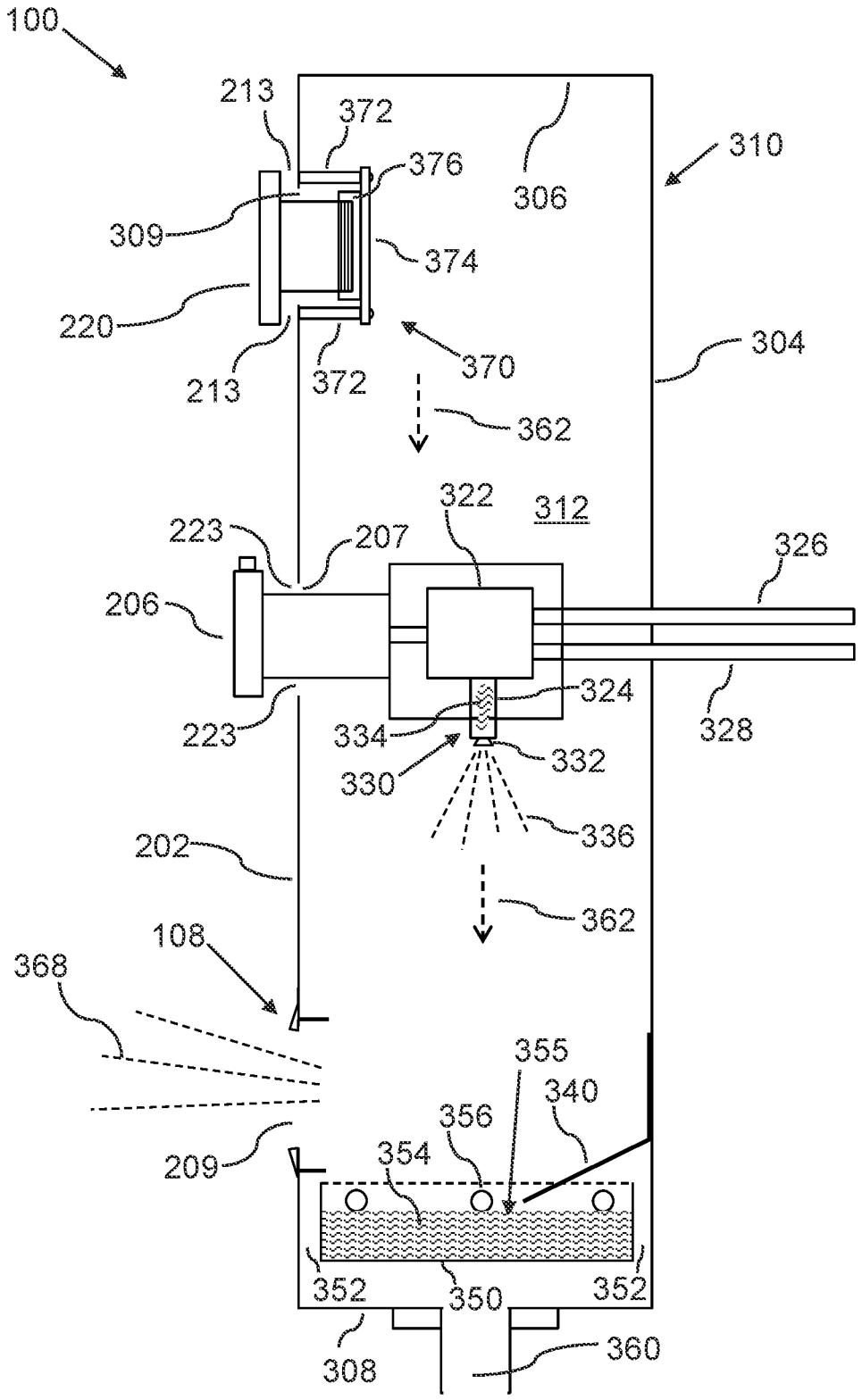
FIG. 3 is a schematic cross-sectional view of a steam shower device, according to an embodiment of the invention.
Figure 10:
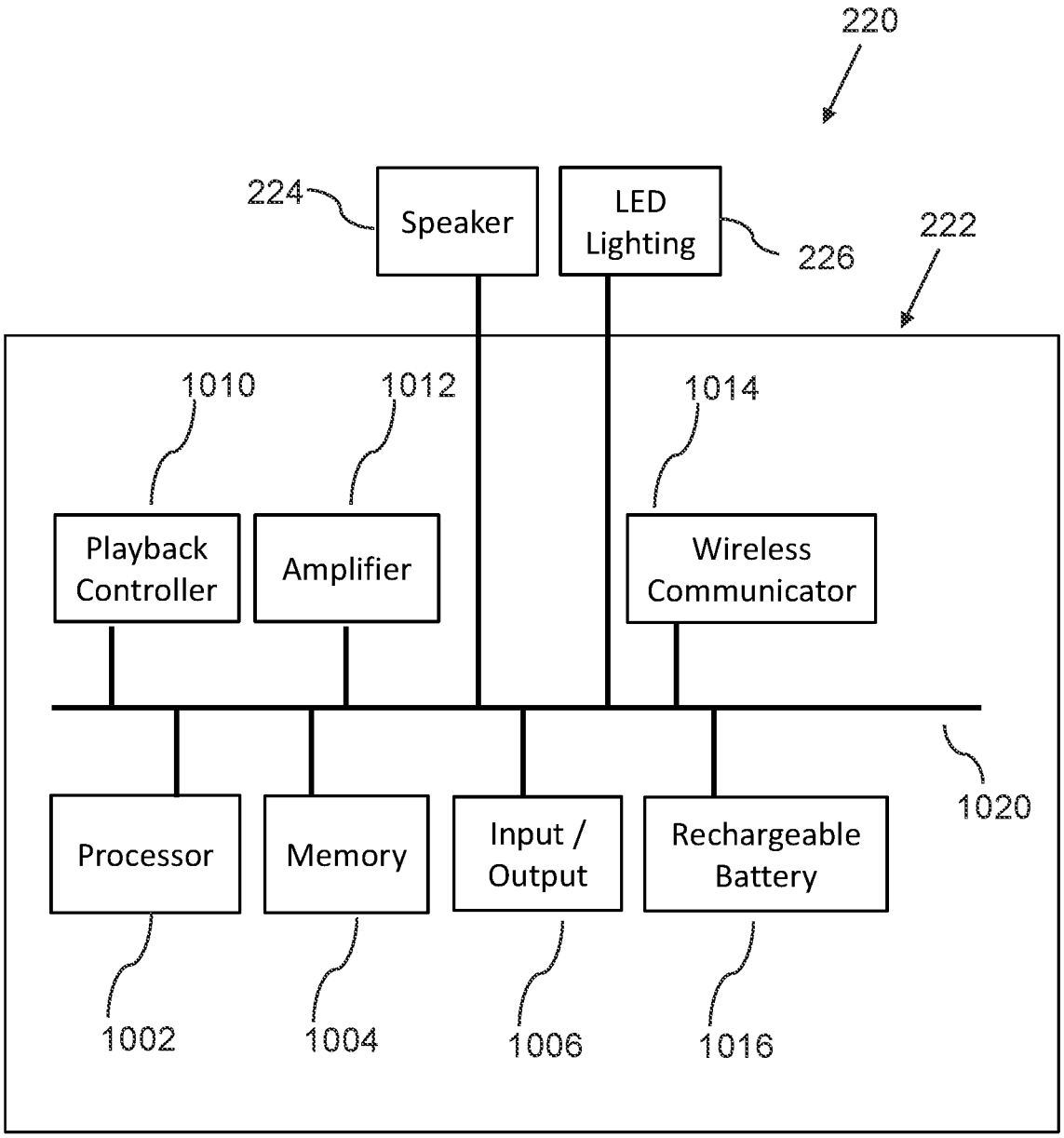
FIG. 10 is a schematic diagram illustrating a wireless electronic module, according to an embodiment of the invention.
Figure 11:
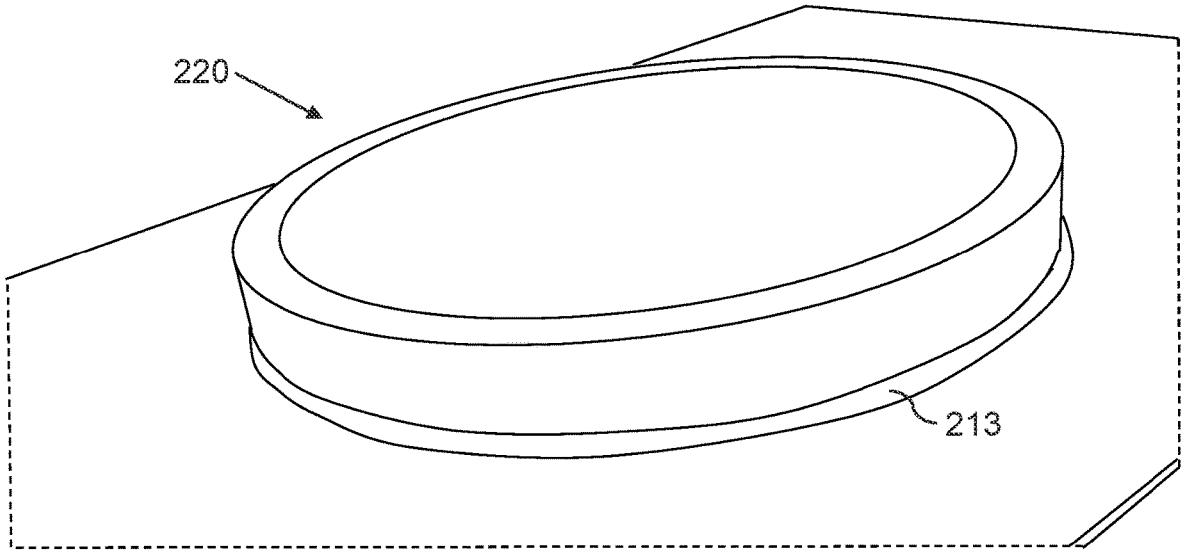
FIG. 11 is a perspective view of a wireless electronic module mounted in a steam enclosure, according to an embodiment of the invention.
Figure 12:
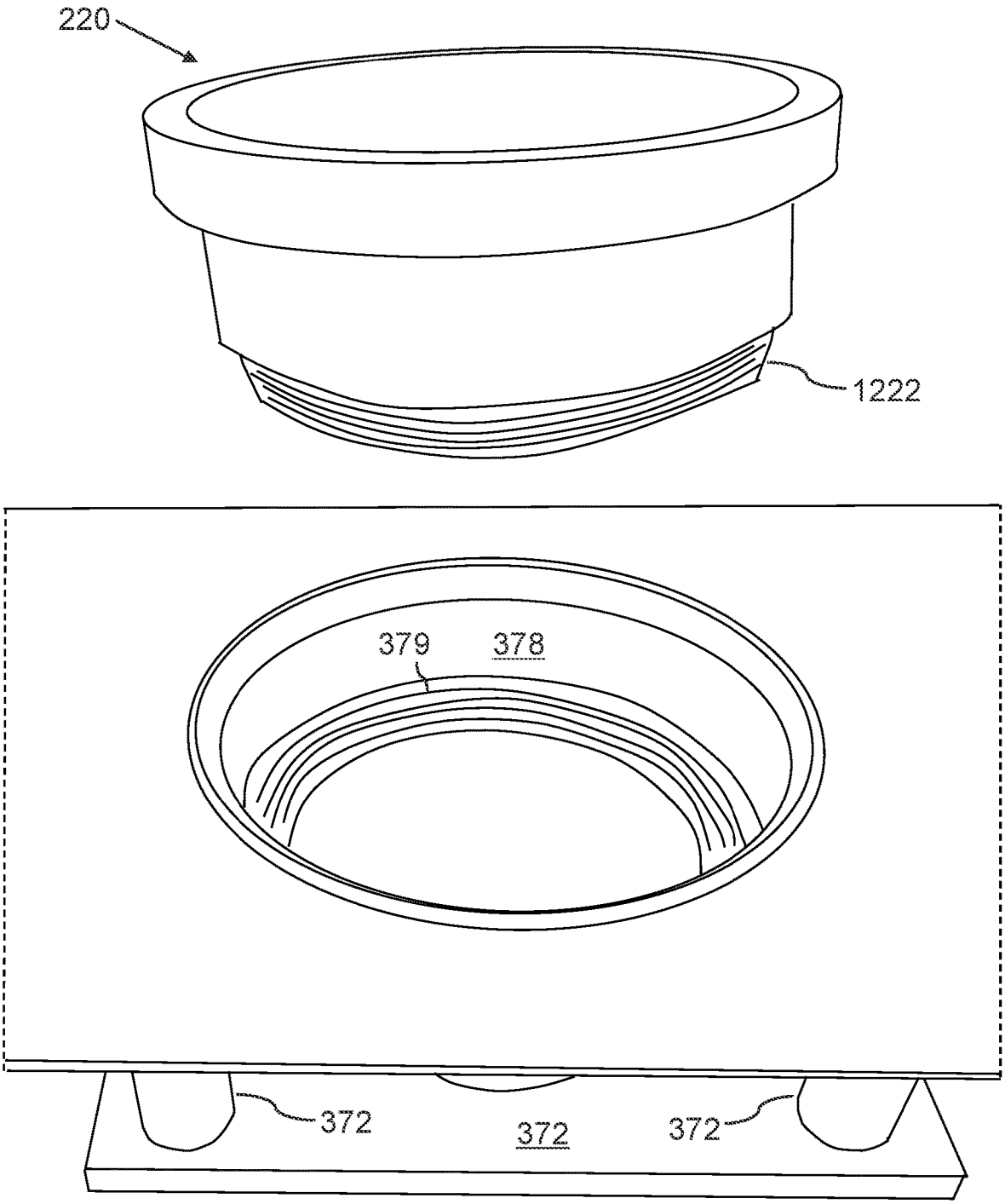
FIG. 12 is a front perspective view of a wireless electronic module that is removed from an electronic module receptor assembly of a steam enclosure, according to an embodiment of the invention.
Figure 13:
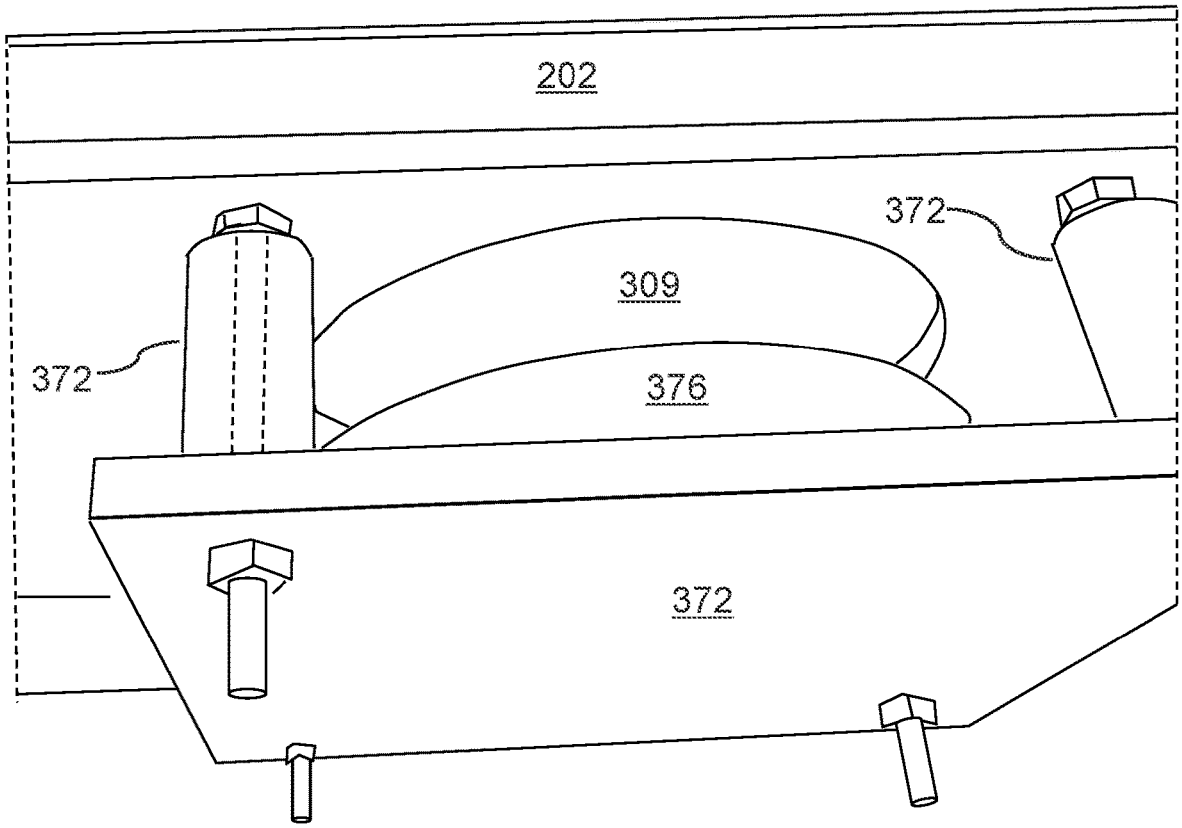
FIG. 13 is a rear perspective view of an electronic module receptor assembly of a steam enclosure, according to an embodiment of the invention.

In related embodiment, as shown in FIG. 2, a steam shower device 100 can include:

a) a front plate 202;

b) a wireless electronic module 220, which can be a BLUETOOTH™ electronic module 220; which, as shown in FIG. 10, can further include:

iii. an electronic control module 222;

iv. at least one speaker 224; and v. at least one lighting element 226, which can be a light emitting diode 226, or a light emitting diode assembly 226;

c) a first vacuum air vent 213, which can be configured as a gap between the wireless electronic module 220 and the front plate 202, as shown in FIG. 3;

d) a steam control dial 206, wherein part of the steam control dial 206 can protrude through a control dial aperture 207 in the front plate 202;

e) a second vacuum air vent 223, which is mounted below the first vacuum air vent 213, wherein the second vacuum air vent 223 can be configured as a gap between the steam control dial 206 and the front plate 202, as shown in FIG. 3;

f) a steam vent 108, comprising a steam aperture 209, which is configured as an aperture in the front plate 202, such that the steam vent 108 is configured to emit steam that is generated in a steam chamber behind the front plate 202; and g) a hot water pan 350, which is a container with an upper opening, such that the hot water pan is configured to collect excess condensed water from the steam 368, such that a hot water reservoir 354 is contained by the hot water pan 350, whereby the hot water reservoir promotes steam formation;

wherein the first and second vacuum air vents 213, 223 are configured to enable an airflow 362 from the first and second vacuum air vents 213, 223 to the steam vent 108, such that the airflow 362 facilitates creation of a continuous and directed stream of the steam 368 exiting the steam vent 108.

Figure 4:
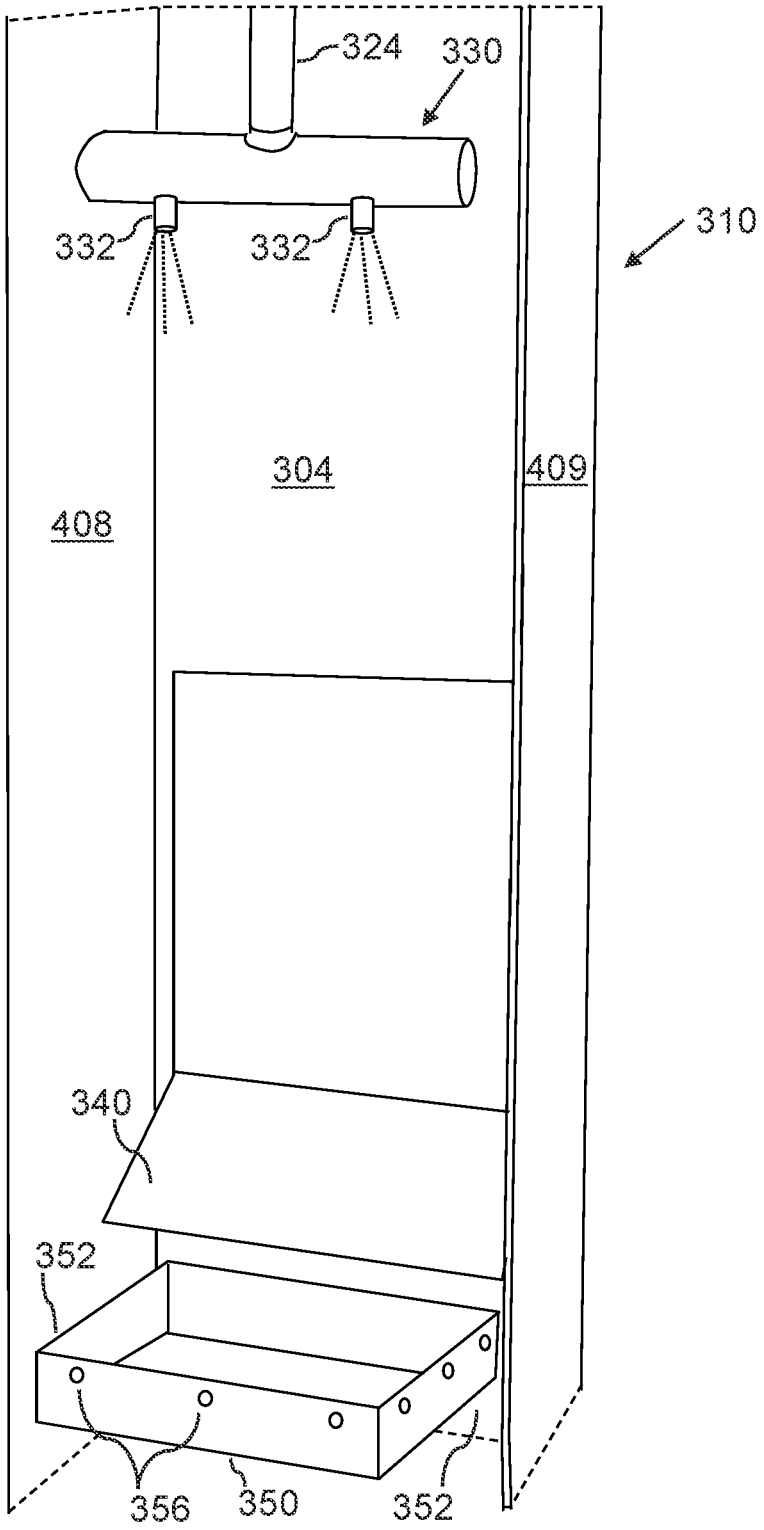
FIG. 4 is a front perspective view of inside parts of the steam shower device, according to an embodiment of the invention.
Figure 14:
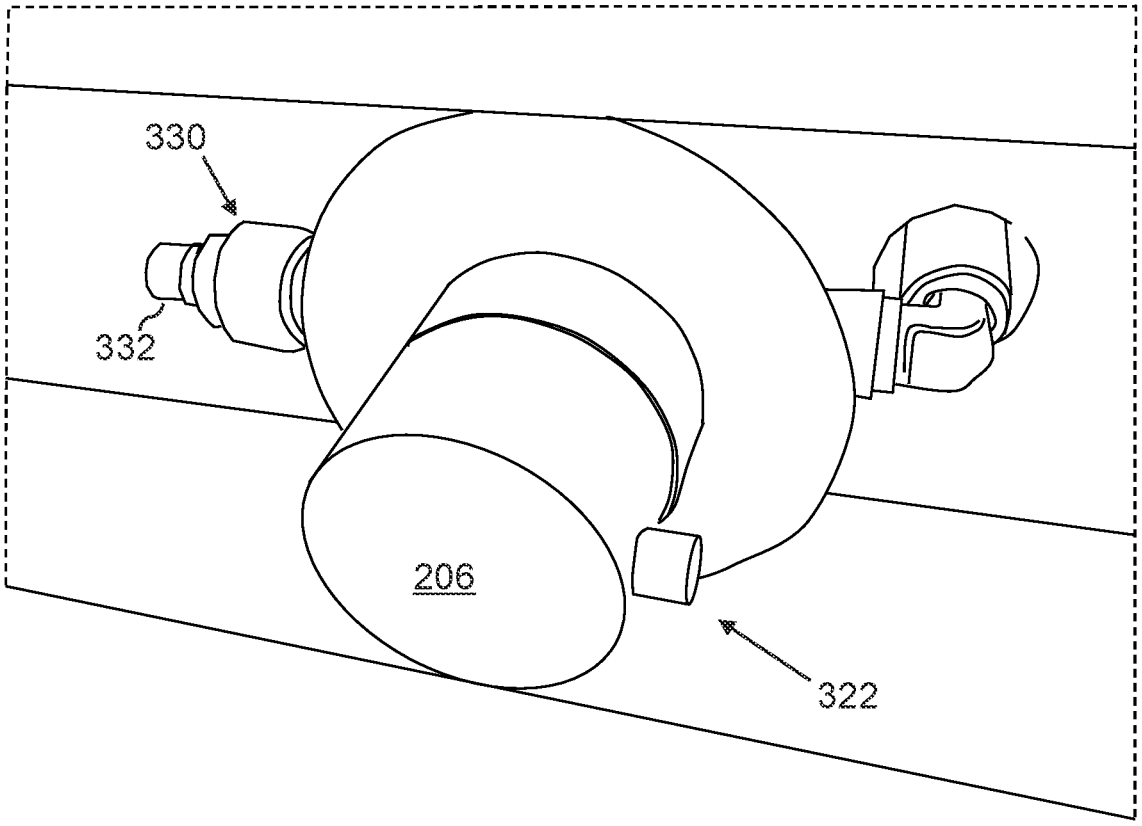
FIG. 14 is a perspective view of a steam mixing valve that is mounted inside a steam enclosure, according to an embodiment of the invention.

In a related embodiment, FIG. 3 illustrates a schematic view of the steam shower device 100, showing components configured to generate steam, such that the steam shower device 100, includes:

a) a steam enclosure 310, including:

i. a front plate 202; a rear wall 304; an upper wall 306, a lower wall 308, and sidewalls 408, 409 (as shown in FIG. 4);

ii. a steam chamber 312; which is a cavity within the enclosure formed by the front plate 202; rear wall 304; upper wall, a lower wall, and sidewalls;

b) a steam mixing valve 322, as shown in FIGS. 3 and 14, which is connected to a hot and cold water supply 326 328, such that the mixing valve further includes:

i. the steam control dial 206, configured such that adjustment of the steam control dial 206, adjusts mixing of hot water and cold water, respectively from a hot water supply 326 and a cold water supply 328, such that mixed water 334 is transmitted to the mixed water line 324;

wherein the second vacuum air vent 223 is configured to be behind the steam control dial 206, such that the second vacuum air vent 223 is hidden behind the steam control dial 206;

c) a steam nozzle assembly 330, including:

ii. at least one steam nozzle head 332;

wherein the at least one steam nozzle head 332 is connected to the mixed water line 324; such that the steam nozzle head 332 is configured to spray the mixed water 334 in a downward direction, such that the mixed water 334 is partially atomized into a steam 336;

d) a visual trim panel 340, which is mounted inside the steam enclosure, such that the visual trim panel 340 is configured to protrude from a rear of the steam enclosure (i.e., from the rear wall 304, such that the visual trim panel 340 is configured to prevent visibility of the hot water pan 350 through the steam vent 108; and e) a hot water pan 350, which is a container with an upper opening, such that the hot water pan is configured to collect excess condensed 354 water from the steam 336, such that the excess condensed water forms 354 a hot water reservoir 355, which is contained by the hot water pan 350, whereby the hot water reservoir promotes steam formation, such that excess condensed water overflows from the hot water pan 350 through at least one side aperture 352, between the hot water pan 350 and walls 202, 304, 408, 409 of the steam enclosure 310, such that the excess water can flow toward the lower end of the steam chamber and to the drain 360.

In a related embodiment, the hot water pan 350 can further comprise overflow apertures 356, such that water contained in the hot water pan 350 drips through the overflow apertures, and can flow through to the drain 360.

In a related embodiment, the steam shower device 100 can further comprise an electronic module receptor assembly 370, which is configured to accept the wireless electronic module 220, such that the wireless electronic module 220 can be removably mounted in the electronic module receptor assembly 370.

In a related embodiment, as shown in FIGS. 3, 11, 12, and 13, the electronic module receptor assembly 370 can further include:

a) a plurality of elongated mounting members 372;

b) a mounting plate 374;

c) a screw receptor 376, which includes a raised cylindrical wall 378, which is threaded 379 on an inner side of the raised cylindrical wall 378;

wherein the front plate 202 includes a receptor aperture 309;

wherein the mounting plate is connected to an inner side of the front plate 202, behind the receptor aperture 309, such that that the elongated mounting members 372 are connected between the inner side of the front plate 202 and an outer side of the front plate 202;

wherein an inner portion of the wireless electronic module 220 is threaded 1222, such that the inner portion of the wireless electronic module 220 can be inserted through the receptor aperture 309 such that the wireless electronic module 220 is configured to screw into (or onto) the screw receptor 376.

In a related embodiment, the steam shower device 100 can be configured to separate the steam from the water, such that the steam exits via the steam vent 108, to a shower user, and the water goes down the drain 360, which is connected to an external drain line, or can also be directed anywhere away from the shower including simply to an outside outlet, if there is no drain access.

In a related embodiment, the steam shower device 100 can function as a stand-alone system, for delivering steam only, or the steam shower device 100 can be part of a full steam shower system 180.

In a further related embodiment, the vacuum air vents 213, 223 functions to allow an airflow from the vacuum air vents 213, 223 to the steam vent 108, which facilitates creation of a continuous and directed stream of steam exiting the steam vent 108, whereby the flow of steam and hot air is raised to the level of a "Fan-type" of force, which blows hot air and steam out through the steam vent 108.

In a further related embodiment, the steam shower device 100 is configured to create an internal water flow, such that the steam shower device 100 creates a vacuum, wherein the water turbulence creates a suction of air flow, which allows air to enter via the vacuum air vents 213, 223 and the steam to exit the chamber via the steam vent 108.

In a further related embodiment, the hot water pan 350 functions to prevent an airflow from the steam chamber 312 to the drain 360, which facilitates creation of a continuous and directed stream of steam exiting the steam vent 108.

In a further related embodiment, the steam nozzle assembly 330 can be positioned below the first vacuum air vent 213.

In a further related embodiment, the steam nozzle assembly 330 can be positioned above the visual trim panel 340 and the steam vent 108.

In a further related embodiment, the hot water pan 350 can be positioned below the visual trim panel 340 and the steam vent 108, and above the drain 360.

In a related embodiment, FIG. 4 illustrates a variant of the steam nozzle assembly 330, with two steam nozzle heads 332, as installed inside the steam enclosure 310.

Figure 5:
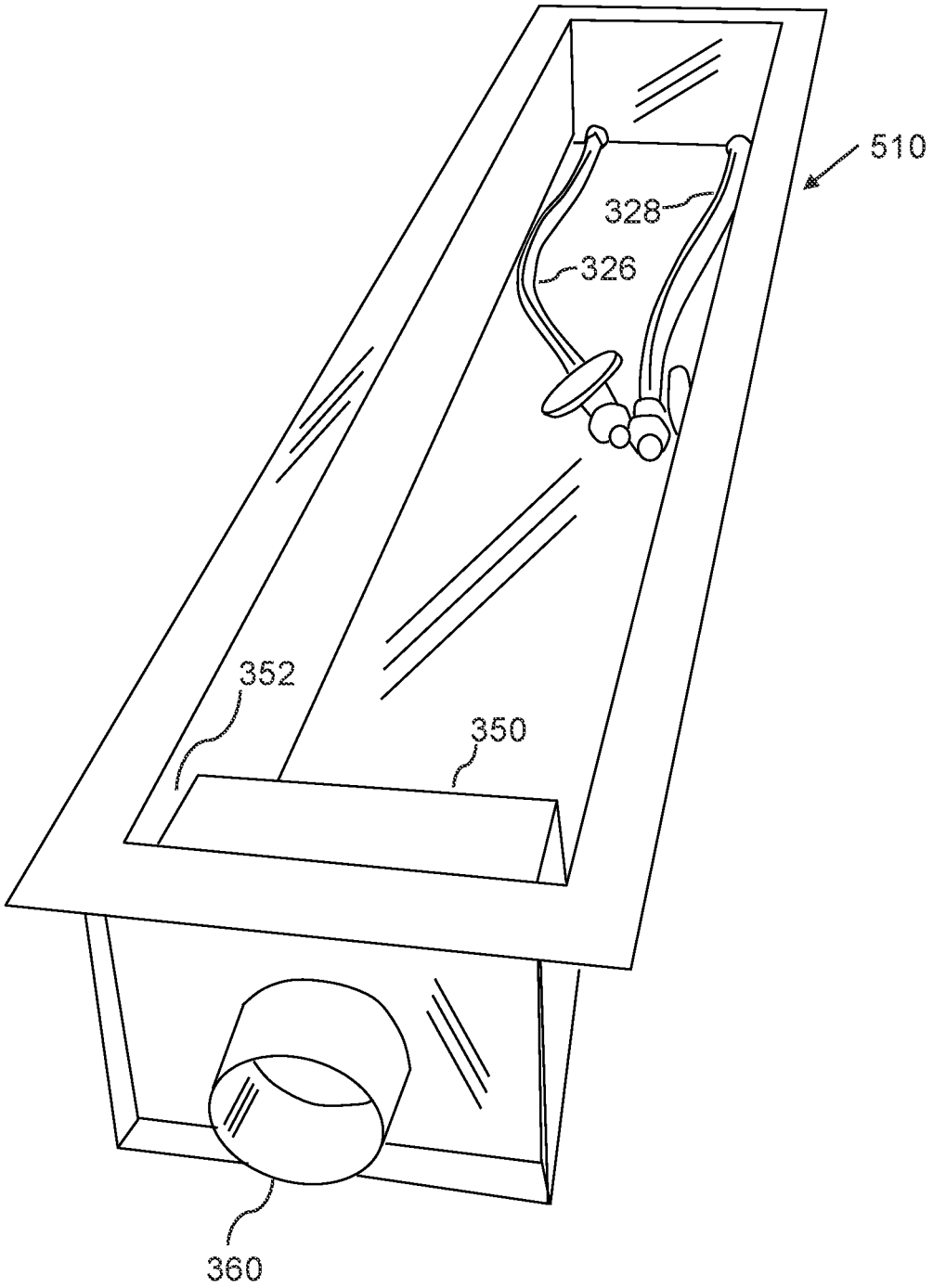
FIG. 5 is a bottom perspective view of a steam enclosure, according to an embodiment of the invention.

In a related embodiment, FIG. 5 illustrates a bottom perspective view of the steam enclosure 510 without the front plate 202, showing the drain 360 and the hot water pan 350, wherein the steam enclosure 510 can be connected to the water supply lines and drain 360.

Figure 6:
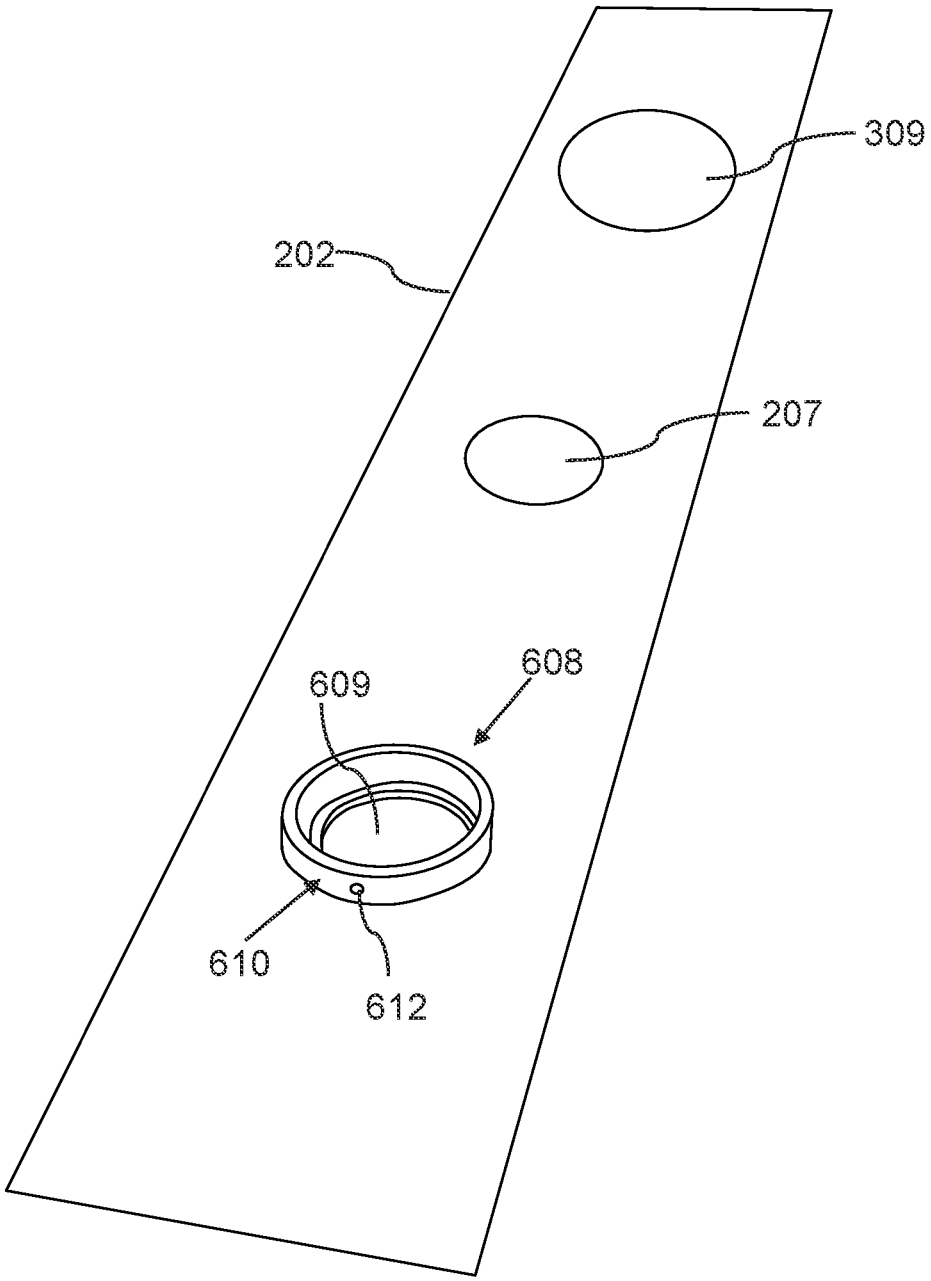
FIG. 6 is a perspective view of an inner side of a front plate, according to an embodiment of the invention.

In a related embodiment, as shown in FIG. 6, the steam vent 608 can further include a perimeter wall 610, which is mounted on an inner side of the front plate 202, such that the perimeter wall 610 surrounds the steam aperture 609 of the steam vent 608, whereby the perimeter wall 610 directs steam through the steam aperture 609 of the steam vent 608. The perimeter wall 610 can further include a perimeter aperture 612 in a lower part of the perimeter wall, which is configured to allow drainage of water that accumulates inside the perimeter wall 610. The perimeter wall 610 can for example have a height of ⅝ inch, with the perimeter aperture 612 having a diameter of ⅛ inch.

Figure 7A:
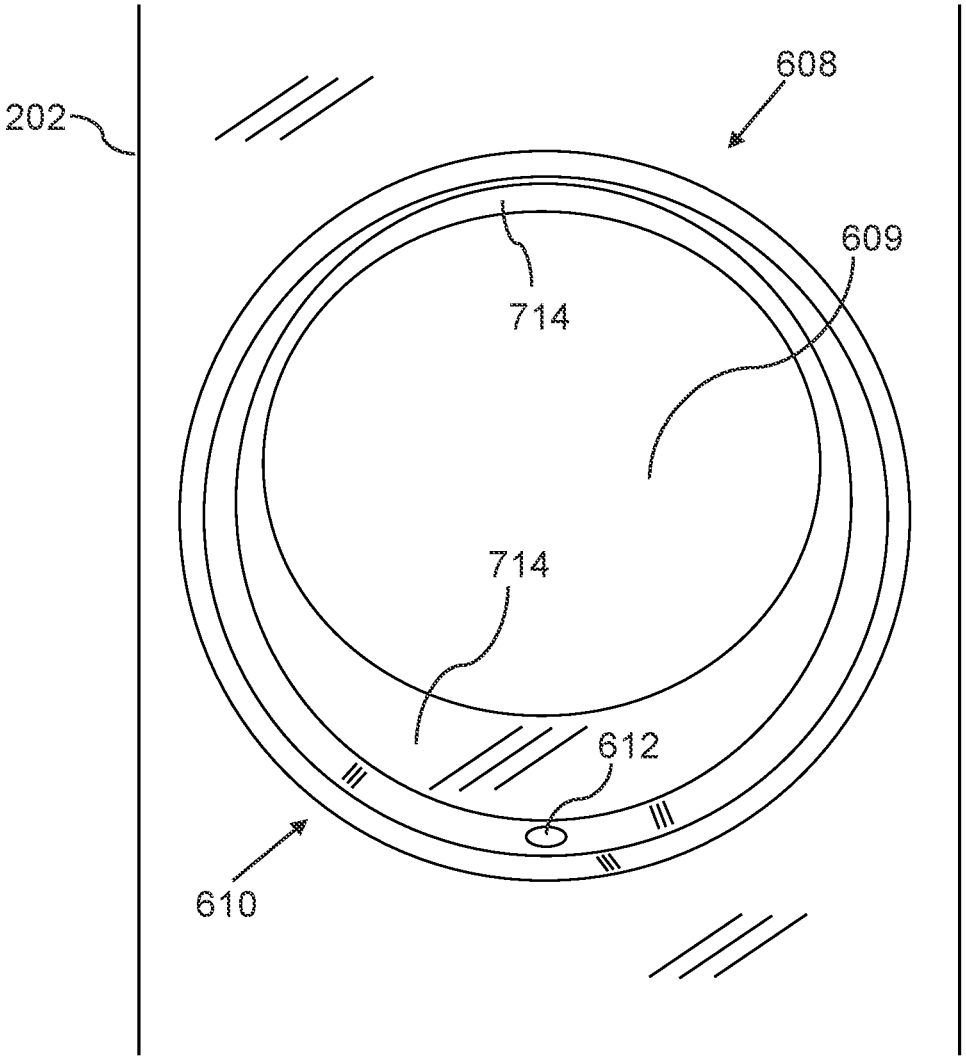
FIG. 7A is a perspective view of an inner side of a steam vent, according to an embodiment of the invention.

In a further related embodiment, as shown in FIG. 7A, the perimeter wall 610, can have a larger diameter than the steam aperture 609 of the steam vent 608, such that a steam ledge 714 is formed, which is a part of the inner side of the front plate 202, inside the perimeter wall 610. The steam ledge 714 serves to prevent water drops to pass through the steam aperture 609.

In a yet further related embodiment, as further shown in FIG. 7A, the perimeter wall 610, can be positioned off-center with respect to the steam aperture 609, such that the steam ledge 714 is wider below the steam aperture 609 than above the steam aperture 609. Water may tend to accumulate inside the lower part of the perimeter wall 610, and is allowed to drain away through the perimeter aperture 612.

Figure 7B:
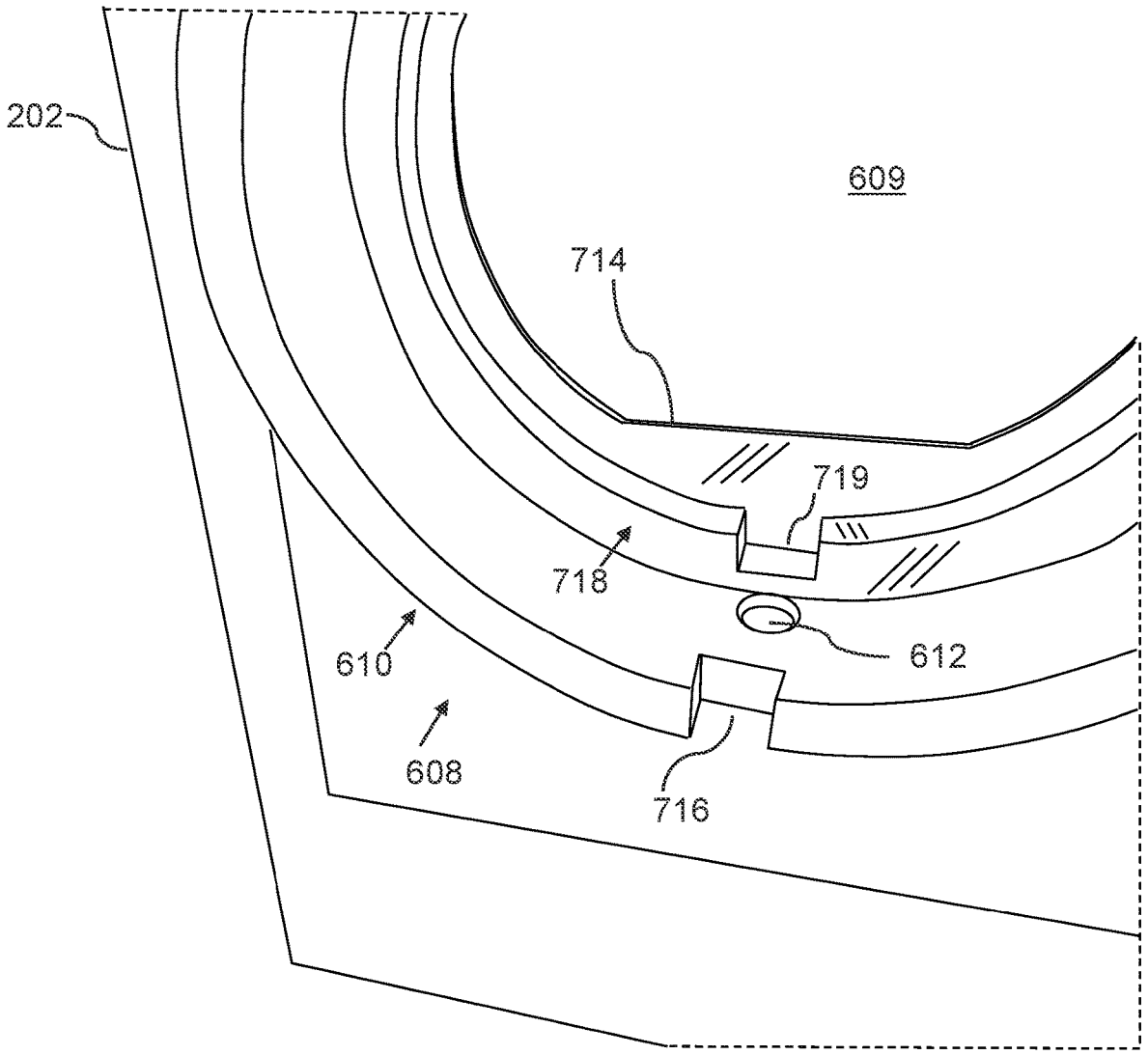
FIG. 7B is a perspective view of an inner side of a steam vent, according to an embodiment of the invention.

In another further related embodiment, as shown in FIG. 7B, the steam vent 608 can further include a ledge 718, which is positioned along an entire inner periphery of the perimeter wall 610.

In a further related embodiment, as shown in FIG. 7B, the ledge 718 can further include a ledge notch 719, which is positioned in a lowest most portion of the ledge 718, such that the ledge notch 719 is adjacent to the perimeter aperture 612, whereby the ledge notch 719 facilitates drainage of accumulated water.

In a further related embodiment, as shown in FIG. 7B, the perimeter wall 610 can further include a perimeter notch 716, which is positioned in a lowest most portion of the perimeter wall 610, such that the perimeter notch 716 is adjacent to the perimeter aperture 612, in an inner edge of the perimeter wall 610, whereby the perimeter notch 716 facilitates drainage of accumulated water.

Figure 8:
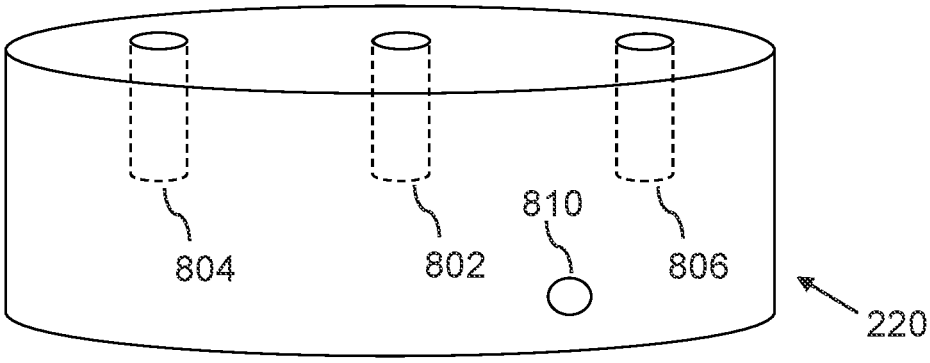
FIG. 8 is a perspective view of a wireless electronic module, according to an embodiment of the invention.
Figure 9:
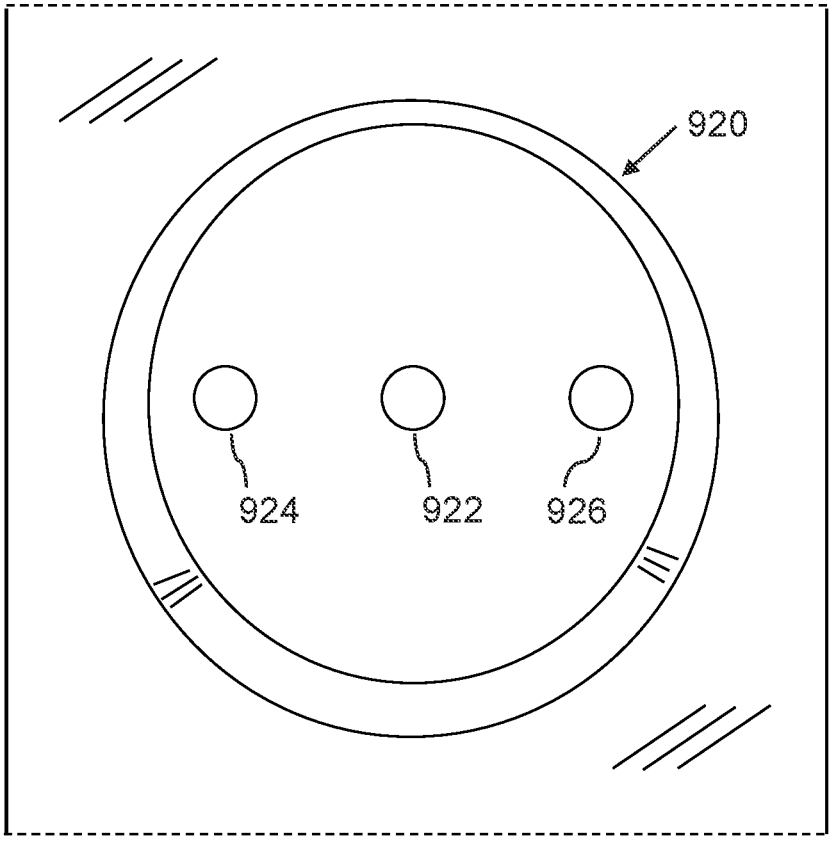
FIG. 9 is a front view of an electronic module cavity, according to an embodiment of the invention.

In a related embodiment, as shown in FIGS. 8 and 9, the wireless electronic module 220 can be configured with a removable electronic control module 222, which can be inserted into a control module receptor 920, which is a cavity in the front plate 202 or in a front plate of the wireless electronic module 220.

In a further related embodiment, the wireless electronic module 220 can further include a module magnet 802, on an inner side of the wireless electronic module 220, which is configured to connect to a corresponding cavity magnet 922 inside the control module receptor 920, such that the module magnet 802 and the cavity magnet 922 are held together by magnetism when connected.

In a further related embodiment, the wireless electronic module 220 can further include module speaker connectors 804 806, on an inner side of the wireless electronic module 220, which is configured to connect to corresponding cavity speaker connectors 924 926 inside the control module receptor 920, such that an amplified speaker signal is transmitted via the module speaker connectors 804 806 and the corresponding cavity speaker connectors 924 926 when they are connected, such that the cavity speaker connectors 924 926 are connected to an additional/external speaker.

In a yet further related embodiment, the module speaker connectors 804 806 and the corresponding cavity speaker connectors 924 926 can be configured to be magnetized, such that they are held together by magnetism when connected. Further, the module speaker connectors 804 806 and the cavity speaker connectors 924 926, can be nickel-plated rare-earth magnets, such that current flows substantially in the nickel plating.

In a related embodiment, as shown in FIG. 10, an electronic control module 222 can include:

a) A processor 1002;
b) A non-transitory memory 1004;
c) An input/output component 1006, which can include playback control keys on a front of the electronic control module;
d) A playback controller 1010; which is configured to control playback of audio received via the wireless communicator 1014;
e) An amplifier 1012, which is configured to receive audio via the wireless communicator 1014;
f) A wireless communicator 1014, which is configured to receive audio via a wireless connection to a mobile device or other wireless audio source, wherein the wireless connection can communicate over BLUETOOTH™, WIFI, or other wireless communication protocol; and
g) A rechargeable battery 1016, which is configured to provide power to the electronic control module 222, such that the rechargeable battery 1016 is connected to the charging port 810, such that the rechargeable battery 1016 can be recharged when the electronic control module 222 is removed from the control module receptor 920; all connected via
h) A data and power bus 1020.

Figure 15A:
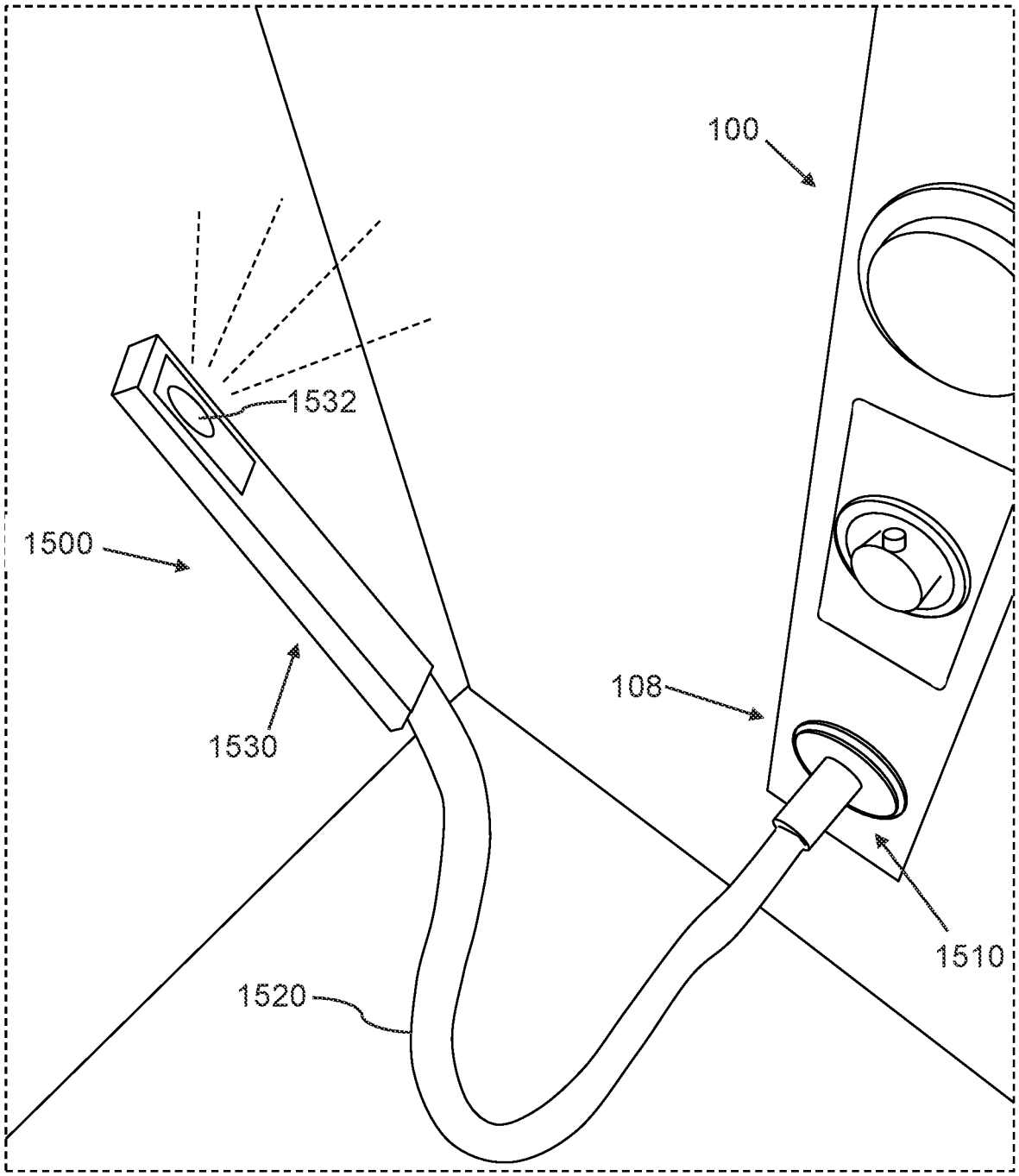
FIG. 15A is a perspective view of a steam wand that is attached to a steam shower system, according to an embodiment of the invention.

In related embodiment, as shown in FIG. 15A, a steam shower device 100 can further include:

a) a hand-held steam hose 1500, including:
   i. a wand connector 1510, which is configured to be detachably connectable to the steam vent 108, wherein the wand connector 1510 comprises a central penetrating aperture 1519;
   ii. a flexible hose 1520, which is hollow; and
   iii. a wand handle 1530, which is hollow, wherein the wand handle 1530 includes a steam exit aperture 1532;
   such that there is a fluid connection from the steam vent 108, via the flexible hose 1520, and the wand handle 1530, to the steam exit aperture 1532;
   such that the steam exiting the steam vent 108, is transported via the hand-held steam hose 1500, and exits via the steam exit aperture 1532.

Figure 15B:
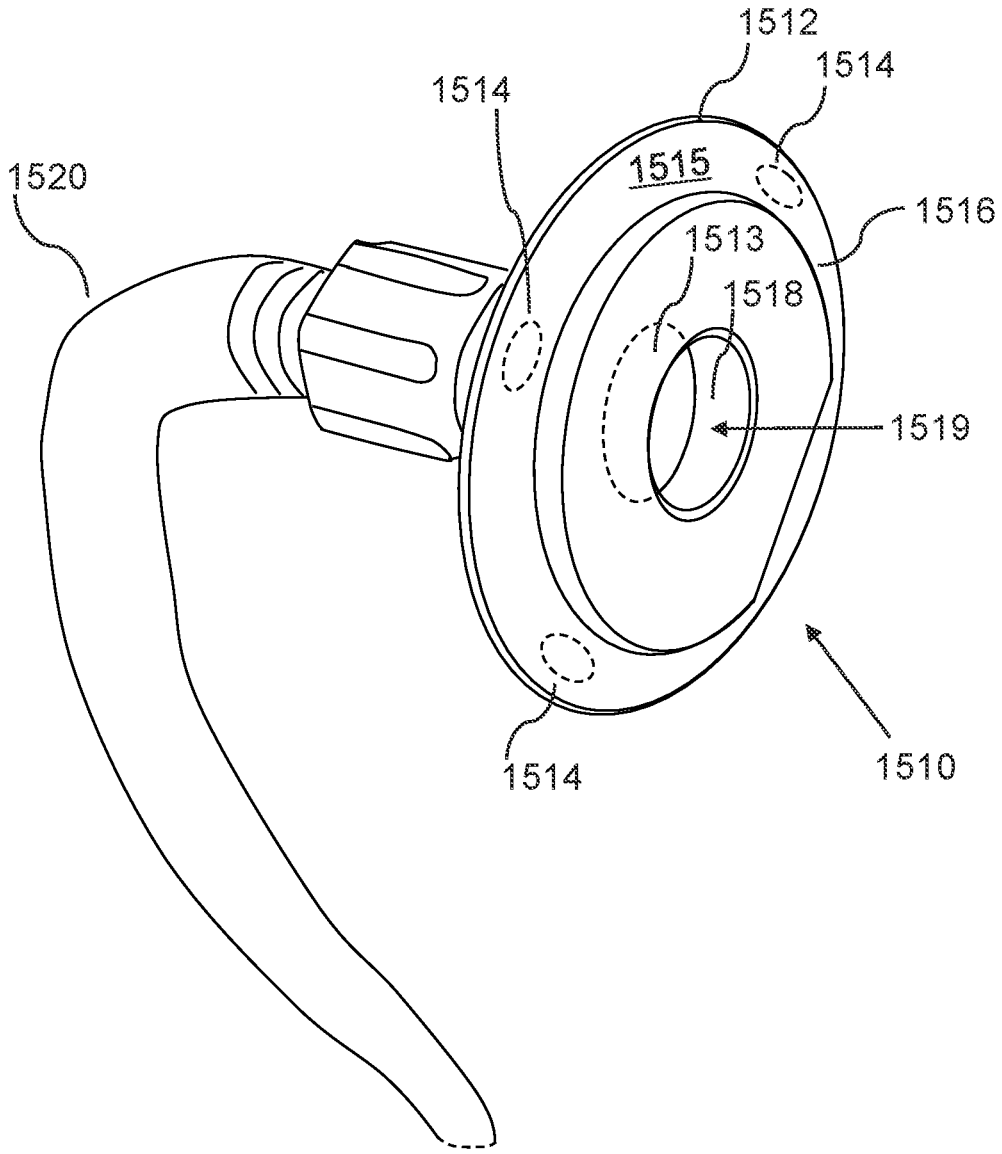
FIG. 15B is a perspective view of a front side of a connector of a steam wand, according to an embodiment of the invention.

In a further related embodiment, as shown in FIG. 15B, the wand connector 1510 can include at least one magnet 1514, and a front surface of the front plate 202 (or other parts of the steam shower device 100, including parts of the steam vent 108) around the steam aperture 209 can be configured to be magnetic, such that the at least one magnet 1514 holds the wand connector 1510 in position on the front surface of the steam shower device 100 around the steam vent 108. The front plate 202 can be made from stainless steel, such that the front plate 202 is magnetic.

In another further related embodiment, as shown in FIG. 15B, the wand connector 1510 can further include:

a) a cover plate 1512, which comprises a first central aperture 1513; and
b) a connector piece 1516, which is connected to an inner side of the cover plate 1512 inside a periphery of the cover plate 1512, such that an outer circular strip 1515 of the cover plate 1512 is exposed, wherein the connector piece comprises a second central aperture 1518;
   such that the first central aperture 1513 and the second central aperture 1518 in combination form the central penetrating aperture 1519;
   such that the connector piece 1516 is configured to be securely insertable into the steam aperture 209 with a friction fit, such that the wand connector 1510 is securely held in position on the steam vent 108.

FIG. 10 represents a block diagram, device, system, apparatus, and computer program product according to various embodiments of the present invention. It shall be understood that each block or step of the block diagram, flowchart and control flow illustrations, and combinations of blocks in the block diagram, flowchart and control flow illustrations, can be implemented by computer program instructions or other means. Although computer program instructions are discussed, an apparatus or system according to the present invention can include other means, such as hardware or some combination of hardware and software, including one or more processors or controllers, for performing the disclosed functions.

In this regard, FIG. 10 depicts the computer devices of various embodiments, each containing several of the key components of a general-purpose computer by which an embodiment of the present invention may be implemented. Those of ordinary skill in the art will appreciate that a computer can include many components. However, it is not necessary that all of these generally conventional components be shown in order to disclose an illustrative embodiment for practicing the invention. The general-purpose computer can include a processing unit and a system memory, which may include various forms of non-transitory storage media such as random access memory (RAM) and read-only memory (ROM). The computer also may include nonvolatile storage memory, such as a hard disk drive, where additional data can be stored.

It shall be understood that the above-mentioned components of the electronic control module 222 are to be interpreted in the most general manner.

For example, the processor 1002 can include a single physical microprocessor or microcontroller, a cluster of processors, a datacenter or a cluster of datacenters, a computing cloud service, and the like.

In a further example, the non-transitory memory 1004 can include various forms of non-transitory storage media, including random access memory and other forms of dynamic storage, and hard disks, hard disk clusters, cloud storage services, and other forms of long-term storage. Similarly, the input/output 1006 can include a plurality of well-known input/output devices, such as screens, keyboards, pointing devices, motion trackers, communication ports, and so forth.

Furthermore, it shall be understood that the electronic control module 222 can include a number of other components that are well known in the art of general computer devices, and therefore shall not be further described herein. This can include system access to common functions and hardware, such as for example via operating system layers such as WINDOWS™, LINUX™, and similar operating system software, but can also include configurations wherein application services are executing directly on server hardware or via a hardware abstraction layer other than a complete operating system.

An embodiment of the present invention can also include one or more input or output components, such as a mouse, keyboard, monitor, and the like. A display can be provided for viewing text and graphical data, as well as a user interface to allow a user to request specific operations. Furthermore, an embodiment of the present invention may be connected to one or more remote computers via a network interface. The connection may be over a local area network (LAN) wide area network (WAN), and can include all of the necessary circuitry for such a connection.

In a related embodiment, the electronic control module 222 communicates with a mobile device or other computer device over a wireless network, which can include Wi-Fi, BLUETOOTH™, ZIGBEE™, and NFC.

Typically, computer program instructions may be loaded onto the computer or other general-purpose programmable machine to produce a specialized machine, such that the instructions that execute on the computer or other programmable machine create means for implementing the functions specified in the block diagrams, schematic diagrams or flowcharts. Such computer program instructions may also be stored in a computer-readable medium that when loaded into a computer or other programmable machine can direct the machine to function in a particular manner, such that the instructions stored in the computer-readable medium produce an article of manufacture including instruction means that implement the function specified in the block diagrams, schematic diagrams or flowcharts.

In addition, the computer program instructions may be loaded into a computer or other programmable machine to cause a series of operational steps to be performed by the computer or other programmable machine to produce a computer-implemented process, such that the instructions that execute on the computer or other programmable machine provide steps for implementing the functions specified in the block diagram, schematic diagram, flowchart block or step.

Accordingly, blocks or steps of the block diagram, flowchart or control flow illustrations support combinations of means for performing the specified functions, combinations of steps for performing the specified functions and program instruction means for performing the specified functions. It will also be understood that each block or step of the block diagrams, schematic diagrams or flowcharts, as well as combinations of blocks or steps, can be implemented by special purpose hardware-based computer systems, or combinations of special purpose hardware and computer instructions, that perform the specified functions or steps.

As an example, provided for purposes of illustration only, a data input software tool of a search engine application can be a representative means for receiving a query including one or more search terms. Similar software tools of applications, or implementations of embodiments of the present invention, can be means for performing the specified functions. For example, an embodiment of the present invention may include computer software for interfacing a processing element with a user-controlled input device, such as a mouse, keyboard, touch screen display, scanner, or the like. Similarly, an output of an embodiment of the present invention may include, for example, a combination of display software, video card hardware, and display hardware. A processing element may include, for example, a controller or microprocessor, such as a central processing unit (CPU), arithmetic logic unit (ALU), or control unit.

Here has thus been described a multitude of embodiments of the steam shower device 100, and devices and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A steam shower device, comprising:

a) a steam enclosure, comprising:
  a front plate, which comprises:
  a first vacuum air vent, which is a first aperture in the front plate; and
  a second vacuum air vent, which is a second aperture in the front plate;
  wherein the second vacuum air vent is positioned below the first vacuum air vent; and
  a steam chamber, which is a cavity within the steam enclosure;

b) a mixed water line, which is configured to connect to a water supply, such that mixed water is transmitted via the mixed water line;

c) a steam nozzle assembly, comprising:
  at least one steam nozzle head;
  wherein the steam nozzle assembly is mounted inside the steam enclosure;

wherein the at least one steam nozzle head is connected to the mixed water line; such that the steam nozzle head is configured to spray the mixed water in a downward direction, such that the mixed water is partially atomized into a steam;

d) a steam vent, comprising a steam aperture, which is configured as an aperture in the front plate, wherein the steam vent is positioned below the second vacuum air vent, such that the steam vent is configured to emit the steam from the steam chamber; and e) a hot water pan, which is a container with an upper opening, such that the hot water pan is configured to collect excess condensed water from the steam, such that the excess condensed water forms a hot water reservoir, which is contained by the hot water pan, whereby the hot water reservoir promotes steam formation;

such that the excess condensed water overflows from the hot water pan through at least one side aperture between the hot water pan and walls of the steam enclosure, such that the excess condensed water flows toward a lower end of the steam chamber;

wherein the first and second vacuum air vents are configured to enable an airflow from the first and second vacuum air vents to the steam vent, such that the airflow facilitates creation of a continuous and directed stream of the steam exiting the steam vent.

2. The steam shower device of claim 1, further comprising:

a steam mixing valve, comprising:

a steam control dial;

wherein the steam mixing valve is configured to connect to the water supply; and the steam mixing valve is configured such that adjustment of the steam control dial adjusts mixing of hot and cold water from the water supply, such that the mixed water is transmitted to the mixed water line.

3. The steam shower device of claim 2, wherein the second vacuum air vent is configured as a gap between the steam control dial and the front plate.

4. The steam shower device of claim 1, wherein the hot water pan further comprises at least one overflow aperture, such that the excess condensed water contained in the hot water pan drips through the at least one overflow aperture and flows toward the lower end of the steam chamber.

5. The steam shower device of claim 1, further comprising:

a visual trim panel, which is mounted inside the steam enclosure, such that the visual trim panel is configured to protrude from a rear of the steam enclosure, such that the visual trim panel is configured to prevent visibility of the hot water pan through the steam vent.

6. The steam shower device of claim 1, further comprising:

a steam mixing valve, including:

a steam control dial, wherein the steam mixing valve is configured to connect to the water supply; and the steam mixing valve is configured such that adjustment of the steam control dial adjusts mixing of hot and cold water from the water supply, such that the mixed water is transmitted to the mixed water line;

wherein the second vacuum air vent is configured to be behind the steam control dial, such that the second vacuum air vent is hidden behind the steam control dial.

7. The steam shower device of claim 1, wherein the steam vent further comprises:

a perimeter wall, which is mounted on an inner side of the front plate, such that the perimeter wall surrounds the steam aperture of the steam vent;

whereby the perimeter wall directs the steam through the steam aperture.

8. The steam shower device of claim 7, wherein the perimeter wall is configured with a larger diameter than a diameter of the steam aperture, such that a steam ledge is formed, such that the steam ledge is a part of the inner side of the front plate that is inside the perimeter wall;

whereby the steam ledge serves to prevent water drops from passing through the steam aperture.

9. The steam shower device of claim 7, wherein the perimeter wall further comprises:

a perimeter aperture, which is positioned in a lower part of the perimeter wall;

such that the perimeter aperture is configured to allow drainage of water that accumulates inside the perimeter wall.

10. The steam shower device of claim 9, wherein the steam vent further comprises a ledge, which is positioned along an entire inner periphery of the perimeter wall, wherein the ledge further comprises a ledge notch, which is positioned in a lowest most portion of the ledge, such that the ledge notch is adjacent to the perimeter aperture, whereby the ledge notch facilitates drainage of accumulated water.

11. The steam shower device of claim 9, wherein the perimeter wall further comprises a perimeter notch, which is positioned in a lowest most portion of the perimeter wall, in an inner edge of the perimeter wall, such that the perimeter notch is adjacent to the perimeter aperture, whereby the perimeter notch facilitates drainage of accumulated water.

12. The steam shower device of claim 1, further comprising:

an electronic module, comprising at least one of:

at least one speaker; and at least one lighting element;

wherein the front plate includes a receptor aperture;

wherein the electronic module is removably mounted in the receptor aperture.

13. The steam shower device of claim 12, wherein the first vacuum air vent is configured as a gap between the electronic module and the front plate.

14. The steam shower device of claim 12, further comprising:

an electronic module receptor assembly, which is configured to accept the electronic module, such that the electronic module is removably mounted in the electronic module receptor assembly, wherein the electronic module receptor assembly comprises:

a plurality of elongated mounting members;

a mounting plate;

a screw receptor, which includes a raised cylindrical wall, which is threaded on an inner side of the raised cylindrical wall;

wherein the mounting plate is connected to an inner side of the front plate, behind the receptor aperture, such that that the elongated mounting members are connected between the inner side of the front plate and an outer side of the front plate;

wherein an inner portion of the electronic module is threaded, such that the inner portion of the electronic module is configured be inserted through the receptor aperture such that the electronic module is configured to screw into the screw receptor.

15. The steam shower device of claim 1, further comprising:

a hand-held steam hose, which is detachably connectable to the steam vent in a first end of the hand-held steam hose, such that a second end of the hand-held steam hose comprises a steam exit aperture;

such that there is a fluid connection from the steam vent, via the hand-held steam hose, to the steam exit aperture;

such that the steam exiting the steam vent, is transported via the hand-held steam hose, and exits via the steam exit aperture.

16. The steam shower device of claim 15, wherein the hand-held steam hose further comprises:

a) a wand connector, which is configured to be detachably connectable to the steam vent, wherein the wand connector comprises a central penetrating aperture;

b) a flexible hose, which is hollow; and c) a wand handle, which is hollow, wherein the wand handle comprises the steam exit aperture;

such that there is the fluid connection from the steam vent, via the flexible hose, and the wand handle, to the steam exit aperture.

17. The steam shower device of claim 16, wherein the wand connector further comprises:

at least one magnet;

wherein a front surface around the steam aperture is configured to be magnetic;

such that the at least one magnet holds the wand connector in position on the front surface of the steam shower device around the steam vent.

18. The steam shower device of claim 17, wherein the front plate is made of stainless steel, such that the front plate is magnetic.

19. The steam shower device of claim 16, wherein the wand connector further comprises:

a) a cover plate, which comprises a first central aperture; and b) a connector piece, which is connected to an inner side of the cover plate inside a periphery of the cover plate, such that an outer circular strip of the cover plate is exposed, wherein the connector piece comprises a second central aperture;

such that the first central aperture and the second central aperture in combination form the central penetrating aperture;

such that the connector piece is configured to be securely insertable into the steam aperture, such that the wand connector is securely held in position on the steam vent.

20. A steam shower device, comprising:

a) a steam enclosure, comprising:

a front plate, which comprises:

a first vacuum air vent, which is a first aperture in the front plate; and a steam chamber, which is a cavity within the steam enclosure;

b) a mixed water line, which is configured to connect to a water supply, such that mixed water is transmitted via the mixed water line;

c) a steam nozzle assembly, comprising:

at least one steam nozzle head;

wherein the steam nozzle assembly is mounted inside the steam enclosure;

wherein the at least one steam nozzle head is connected to the mixed water line; such that the steam nozzle head is configured to spray the mixed water in a downward direction, such that the mixed water is partially atomized into a steam; and d) a steam vent, comprising a steam aperture, which is configured as an aperture in the front plate, wherein the steam vent is positioned below the first vacuum air vent, such that the steam vent is configured to emit the steam from the steam chamber, wherein the steam vent further comprises:

a perimeter wall, which is mounted on an inner side of the front plate, such that the perimeter wall surrounds the steam aperture of the steam vent;

whereby the perimeter wall directs the steam through the steam aperture, wherein the perimeter wall further comprises:

a perimeter aperture, which is positioned in a lower part of the perimeter wall;

such that the perimeter aperture is configured to allow drainage of water that accumulates inside the perimeter wall; and a ledge, which is positioned along an entire inner periphery of the perimeter wall, wherein the ledge further comprises a ledge notch, which is positioned in a lowest most portion of the ledge, such that the ledge notch is adjacent to the perimeter aperture, whereby the ledge notch facilitates drainage of accumulated water;

wherein the first vacuum air vent is configured to enable an airflow from the first vacuum air vent to the steam vent, such that the airflow facilitates creation of a continuous and directed stream of the steam exiting the steam vent.

21. The steam shower device of claim 20, wherein the front plate further comprises:

a second vacuum air vent, which is a second aperture in the front plate;

wherein the second vacuum air vent is positioned below the first vacuum air vent;

wherein the first and second vacuum air vents are configured to enable the airflow from the first and second vacuum air vents to the steam vent.

22. The steam shower device of claim 20, further comprising:

a hot water pan, which is a container with an upper opening, such that the hot water pan is configured to collect excess condensed water from the steam, such that the excess condensed water forms a hot water reservoir, which is contained by the hot water pan, whereby the hot water reservoir promotes steam formation;

such that the excess condensed water overflows from the hot water pan through at least one side aperture between the hot water pan and walls of the steam enclosure, such that the excess condensed water flows toward a lower end of the steam chamber.

23. The steam shower device of claim 22, wherein the hot water pan further comprises at least one overflow aperture, such that the excess condensed water contained in the hot water pan drips through the at least one overflow aperture and flows toward the lower end of the steam chamber.

24. The steam shower device of claim 20, wherein the perimeter wall is configured with a larger diameter than a diameter of the steam aperture, such that a steam ledge is formed, such that the steam ledge is a part of the inner side of the front plate that is inside the perimeter wall;

whereby the steam ledge serves to prevent water drops from passing through the steam aperture.

25. The steam shower device of claim 20, wherein the perimeter wall further comprises a perimeter notch, which is positioned in a lowest most portion of the perimeter wall, in an inner edge of the perimeter wall, such that the perimeter notch is adjacent to the perimeter aperture, whereby the perimeter notch facilitates drainage of accumulated water.

26. A steam shower device, comprising:

a) a steam enclosure, comprising:

a front plate, which comprises:

a first vacuum air vent, which is a first aperture in the front plate; and a second vacuum air vent, which is a second aperture in the front plate;

wherein the second vacuum air vent is positioned below the first vacuum air vent; and a steam chamber, which is a cavity within the steam enclosure;

b) a mixed water line, which is configured to connect to a water supply, such that mixed water is transmitted via the mixed water line;

c) a steam nozzle assembly, comprising:

at least one steam nozzle head;

wherein the steam nozzle assembly is mounted inside the steam enclosure;

wherein the at least one steam nozzle head is connected to the mixed water line; such that the steam nozzle head is configured to spray the mixed water in a downward direction, such that the mixed water is partially atomized into a steam;

d) a steam vent, comprising a steam aperture, which is configured as an aperture in the front plate, wherein the steam vent is positioned below the second vacuum air vent, such that the steam vent is configured to emit the steam from the steam chamber; and e) an electronic module, comprising at least one of:

at least one speaker; and at least one lighting element;

wherein the front plate includes a receptor aperture; and wherein the electronic module is removably mounted in the receptor aperture;

wherein the first and second vacuum air vents are configured to enable an airflow from the first and second vacuum air vents to the steam vent, such that the airflow facilitates creation of a continuous and directed stream of the steam exiting the steam vent.

27. A steam shower device, comprising:

a) a steam enclosure, comprising:

a front plate, which comprises:

a first vacuum air vent, which is a first aperture in the front plate; and a second vacuum air vent, which is a second aperture in the front plate;

wherein the second vacuum air vent is positioned below the first vacuum air vent; and a steam chamber, which is a cavity within the steam enclosure;

b) a mixed water line, which is configured to connect to a water supply, such that mixed water is transmitted via the mixed water line;

c) a steam nozzle assembly, comprising:

at least one steam nozzle head;

wherein the steam nozzle assembly is mounted inside the steam enclosure;

wherein the at least one steam nozzle head is connected to the mixed water line; such that the steam nozzle head is configured to spray the mixed water in a downward direction, such that the mixed water is partially atomized into a steam;

d) a steam vent, comprising a steam aperture, which is configured as an aperture in the front plate, wherein the steam vent is positioned below the second vacuum air vent, such that the steam vent is configured to emit the steam from the steam chamber; and e) a hand-held steam hose, which is detachably connectable to the steam vent in a first end of the hand-held steam hose, such that a second end of the hand-held steam hose comprises a steam exit aperture;

such that there is a fluid connection from the steam vent, via the hand-held steam hose, to the steam exit aperture; and such that the steam exiting the steam vent, is transported via the hand-held steam hose, and exits via the steam exit aperture.

wherein the first and second vacuum air vents are configured to enable an airflow from the first and second vacuum air vents to the steam vent, such that the airflow facilitates creation of a continuous and directed stream of the steam exiting the steam vent.

28. A steam shower device, comprising:

a) a steam enclosure, comprising:

a front plate, which comprises:

a first vacuum air vent, which is a first aperture in the front plate;

a second vacuum air vent, which is a second aperture in the front plate;

wherein the second vacuum air vent is positioned below the first vacuum air vent and a steam chamber, which is a cavity within the steam enclosure;

b) a mixed water line, which is configured to connect to a water supply, such that mixed water is transmitted via the mixed water line;

c) a steam nozzle assembly, comprising:

at least one steam nozzle head;

wherein the steam nozzle assembly is mounted inside the steam enclosure;

wherein the at least one steam nozzle head is connected to the mixed water line; such that the steam nozzle head is configured to spray the mixed water in a downward direction, such that the mixed water is partially atomized into a steam; and d) a steam vent, comprising a steam aperture, which is configured as an aperture in the front plate, wherein the steam vent is positioned below the first vacuum air vent, such that the steam vent is configured to emit the steam from the steam chamber;

wherein the first and second vacuum air vents are configured to enable an airflow from the first and second vacuum air vents to the steam vent, such that the airflow facilitates creation of a continuous and directed stream of the steam exiting the steam vent.

* * * * *